US011329381B2

(12) United States Patent
Lee et al.

(10) Patent No.: US 11,329,381 B2
(45) Date of Patent: May 10, 2022

(54) DUAL-BAND ANTENNA USING COUPLED FEEDING AND ELECTRONIC DEVICE COMPRISING THE SAME

(71) Applicant: SAMSUNG ELECTRONICS CO., LTD., Suwon-si (KR)

(72) Inventors: Young Ki Lee, Suwon-si (KR); Sun Woo Lee, Suncheon-si (KR); Dooseok Choi, Hwaseong-si (KR)

(73) Assignee: SAMSUNG ELECTRONICS CO.. LTD., Suwon-si (KR)

( * ) Notice: Subject to any disclaimer, the term of this patent is extended or adjusted under 35 U.S.C. 154(b) by 61 days.

(21) Appl. No.: 17/017,133

(22) Filed: Sep. 10, 2020

(65) Prior Publication Data

US 2021/0203071 A1 Jul. 1, 2021

(30) Foreign Application Priority Data

Dec. 31, 2019 (KR) ..... 10-2019-0178972

(51) Int. Cl.

| | |
|---|---|
| ***H01Q 5/35*** | (2015.01) |
| ***H01Q 1/48*** | (2006.01) |
| ***H01Q 1/52*** | (2006.01) |
| ***H01Q 1/24*** | (2006.01) |

(52) U.S. Cl.

CPC ..... *H01Q 5/35* (2015.01); *H01Q 1/243* (2013.01); *H01Q 1/48* (2013.01); *H01Q 1/521* (2013.01)

(58) Field of Classification Search

CPC .. H01Q 5/35; H01Q 1/24; H01Q 1/48; H01Q 1/52

USPC ..... 343/848

See application file for complete search history.

(56) References Cited

U.S. PATENT DOCUMENTS

| | | | | |
|---|---|---|---|---|
| 6,388,619 | B2 | 5/2002 | Perrott et al. | |
| 6,507,319 | B2 | 1/2003 | Sikina | |
| 8,723,732 | B2 | 5/2014 | Lee et al. | |
| 2014/0043189 | A1* | 2/2014 | Lee | H01Q 21/08 342/368 |
| 2018/0040955 | A1 | 2/2018 | Vouvakis et al. | |
| 2019/0157762 | A1 | 5/2019 | Shibata et al. | |
| 2019/0165472 | A1* | 5/2019 | Yun | H04B 1/40 |
| 2019/0237879 | A1 | 8/2019 | Park et al. | |
| 2019/0296449 | A1 | 9/2019 | Hashimoto | |
| 2020/0136269 | A1 | 4/2020 | Choi et al. | |

FOREIGN PATENT DOCUMENTS

KR 10-2020-0046482 A 5/2020

* cited by examiner

*Primary Examiner* — Andrea Lindgren Baltzell
(74) *Attorney, Agent, or Firm* — Sughrue Mion, PLLC

(57) ABSTRACT

An antenna includes a first dielectric substrate and a first feeding element. The first dielectric substrate includes a first insulating layer, and a first radiation plate including a first opening that exposes an upper surface of the first insulating layer. The first feeding element is disposed in the first opening to penetrate the first insulating layer in a direction extending toward a lower surface of the first dielectric substrate. The first feeding element is insulated from the first radiation plate by the first insulating layer. The first feeding element includes a first conductive plate having an upper surface located on a same plane as an upper surface of the first radiation plate.

20 Claims, 19 Drawing Sheets

DUAL-BAND ANTENNA USING COUPLED FEEDING AND ELECTRONIC DEVICE COMPRISING THE SAME

This application claims priority from Korean Patent Application No. 10-2019-0178972 filed on Dec. 31, 2019 in the Korean Intellectual Property Office, the entire contents of which are herein incorporated by reference in its entirety.

BACKGROUND

1. Technical Field

The present disclosure relates to a dual-band antenna using coupled feeding and an electronic device including the same.

2. Description of the Related Art

With development of wireless communication technology, electronic devices (e.g., communication electronic devices) have been universally used in daily life, and the usage of contents has exponentially increased accordingly. Due to the rapid increase in the usage of the contents, network capacity gradually reaches the limit, and as low latency data communication is required, next-generation wireless communication technologies (e.g., 5G communication) or high-speed wireless communication technologies such as WIGIG (wireless gigabit alliance) (e.g., 802.11AD) have been developed.

The next-generation wireless communication technology may use a millimeter wave of substantially 20 GHz or more. For example, next-generation wireless communication technologies may simultaneously use a 28 GHz band and a 39 GHz band. Therefore, mounting of one antenna supporting dual-band inside an electronic device gradually being miniaturized may be efficient in terms of space utilization of the electronic device.

Although a design that satisfies the dual-band with the dual feeding has been performed, a technology that satisfies the dual-band using a single feeding has been required. When the dual-band is implemented using the single feeding, there are disadvantages of failing to control each frequency band independently of each other, and a problem of a change in a radiation pattern of the high frequency band due to the harmonic component. Therefore, there is a need for an antenna that adjusts each frequency band independently while using a single feeding, and does not change the radiation pattern of the high frequency band.

SUMMARY

It is an aspect to provide an antenna capable of adjusting each frequency band independently of each other, using coupled feeding.

It is another aspect to provide an antenna which does not change a radiation pattern of the high frequency band, while using a single feeding.

It is another aspect to provide an antenna capable of reducing the size, while satisfying process rules by placing dummy cells.

It is another aspect to provide an antenna which improves communication performance by placing a plurality of antennas.

However, various aspects of the present disclosure are not restricted to the ones set forth herein. The above and other aspects will become more apparent to one of ordinary skill in the art by referencing the detailed description and given below.

According to an aspect of an embodiment, there is provided an antenna comprising a first dielectric substrate which includes a first insulating layer, and a first radiation plate including a first opening configured to expose an upper surface of the first insulating layer; and a first feeding element which is disposed in the first opening to penetrate the first insulating layer in a direction extending toward a lower surface of the first dielectric substrate, is the first feeding element being insulated from the first radiation plate by the first insulating layer, wherein the first feeding element includes a first conductive plate having an upper surface located on a same plane as an upper surface of the first radiation plate.

According to another aspect of an embodiment, there is provided an antenna array comprising a first antenna which includes a first radiation plate including a first opening, and a first conductive plate disposed in the first opening; and a second antenna which is disposed to be spaced apart from the first antenna at a first interval in a first direction, and includes a second radiation plate including a second opening, and a second conductive plate disposed in the second opening, wherein the first antenna is insulated from the second antenna by a first insulating layer, the first opening exposes an upper surface of the first conductive plate, and an upper surface of a second insulating layer which insulates the first conductive plate and the first radiation plate, and the second opening exposes an upper surface of the second conductive plate, and an upper surface of a third insulating layer which insulates the second conductive plate and the second radiation plate.

According to another aspect of an embodiment, there is provided a communication device comprising a first radiation plate including a first opening; a second radiation plate including a second opening, is the second radiation plate being disposed under the first radiation plate to be spaced apart from a lower surface of the first radiation plate; a third radiation plate including a third opening, is the third radiation plate being disposed under the second radiation plate to be spaced apart from a lower surface of the second radiation plate; a ground plane including a fourth opening, is the ground plane being disposed under the third radiation plate to be spaced apart from a lower surface of the third radiation plate; a first feeding element; and a first communication circuit which is electrically connected to the first feeding element and transmits and receives signals, wherein the first feeding element is spaced apart from the first radiation plate in the first opening, and extends in a direction away from the lower surface of the first radiation plate through the first opening, the first feeding element is spaced apart from the second radiation plate in the second opening, and extends in a direction away from the lower surface of the second radiation plate through the second opening, the first feeding element is spaced apart from the third radiation plate in the third opening, and extends in a direction away from the lower surface of the third radiation plate through the third opening, the first feeding element is spaced apart from the ground plane in the fourth opening, and extends in a direction away from the lower surface of the ground plane through the fourth opening, and the first feeding element includes a first conductive plate located on a same plane as an upper surface of the first radiation plate, a second conductive plate located on a same plane as an upper surface of the second radiation plate, and a third conductive plate located on a same plane as an upper surface of the third radiation plate.

BRIEF DESCRIPTION OF THE DRAWINGS

The above and other will become more apparent by describing in detail exemplary embodiments thereof with reference to the attached drawings, in which.

DETAILED DESCRIPTION

Hereinafter, various embodiments will be described with reference to the attached drawings.

Figure 1:
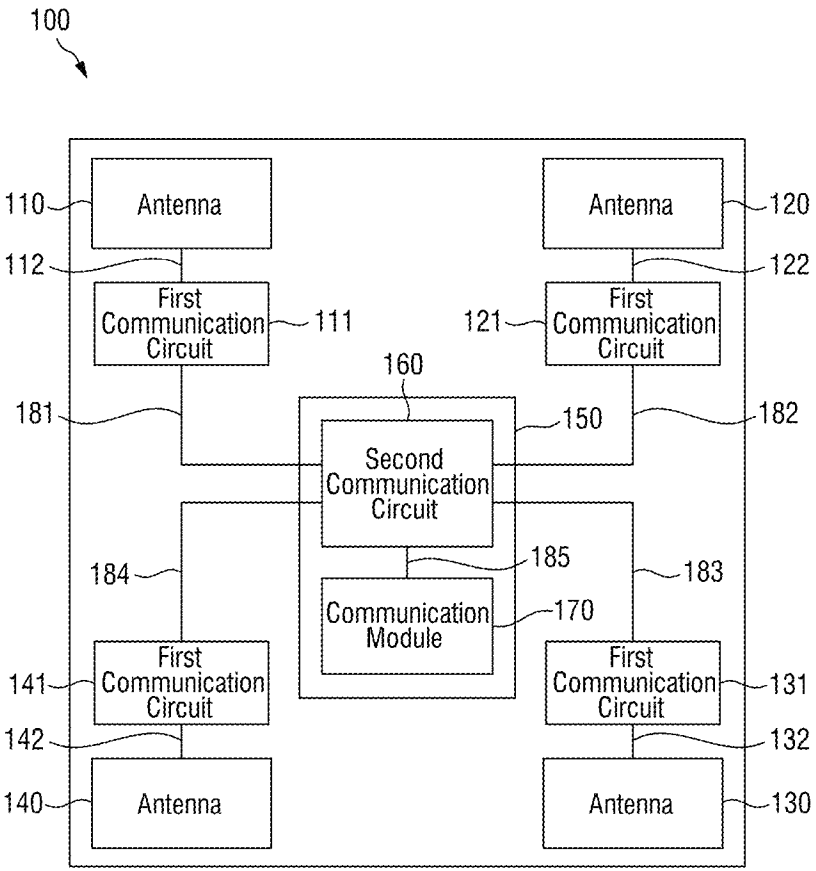
FIG. 1 is a diagram for explaining an electronic device that supports wireless communication, according to some embodiments.

FIG. 1 is a diagram for explaining an electronic device that supports wireless communication, according to some embodiments.

Referring to FIG. 1, an electronic device 100 may include a plurality of antennas 110, 120, 130 and 140. While four antennas 110, 120, 130, and 140 are illustrated in FIG. 1, embodiments are not limited thereto. In some embodiments, fewer than four antennas may be provided. For example, in some embodiments, only one antenna may be provided. In other embodiments, the number of antennas may be more than four.

Referring to FIG. 1, the electronic device 100 may include a plurality of first communication circuits 111, 121, 131 and 141 corresponding respectively to the plurality of antennas 110, 120, 130, and 140. While four first communication circuits 111, 121, 131, and 141 are illustrated in FIG. 1, embodiments are not limited thereto. In some embodiments, fewer than four first communication circuits may be provided. For example, in some embodiments, only one first communication circuit may be provided. In other embodiments, the number of first communication circuits may be more than four. The first communication circuits 111, 121, 131 and 141 may be, for example, a Radio Frequency Integrated Circuit (RFIC). The antennas 110, 120, 130 and 140 may be electrically connected to the first communication circuits 111, 121, 131 and 141 through the first conductive lines 112, 122, 132 and 142, respectively. The antennas 110, 120, 130 and 140 may receive a Radio Frequency (RF) signal from the outside (e.g., from another electronic device (not shown) outside the electronic device 100) and transmit the RF signal to the first communication circuits 111, 121, 131 and 141. The antennas 110, 120, 130 and 140 may transmit the RF signal to the first communication circuits 111, 121, 131 and 141 through the first conductive lines 112, 122, 132 and 142, respectively. The first communication circuits 111, 121, 131 and 141 may convert the RF signal received respectively from the antennas 110, 120, 130 and 140 into an Intermediate Frequency (IF) signal.

Referring to FIG. 1, the electronic device 100 may include a second communication circuit 160. For example, the second communication circuit 160 may be an Intermediate Frequency Integrated Circuit (IFIC). The first communication circuits 111, 121, 131 and 141 may be electrically connected to the second communication circuit 160 through second conductive lines 181, 182, 183 and 184, respectively. The first communication circuits 111, 121, 131 and 141 may transmit the converted IF signal to the second communication circuit 160 through the second conductive lines 181, 182, 183 and 184, respectively. The second communication circuit 160 may convert the IF signal received from the first communication circuits 111, 121, 131 and 141 into a baseband frequency signal.

Referring to FIG. 1, the electronic device 100 may include a communication module 170. The communication module 170 may be, for example, a processor. The processor may include one or more microprocessors or central processing units (CPUs). The second communication circuit 160 may be electrically connected to the communication module 170 through a third conductive line 185. The second communication circuit 160 may transmit the converted baseband frequency signal to the communication module 170. The communication module 170 may not receive the same baseband frequency signal converted from the RF signals from each of the antennas 110, 120, 130, and 140, but embodiments are not limited thereto. In some embodiments, a plurality of third conductive lines 185 may be provided.

The communication module 170 may transmit a baseband frequency signal to the second communication circuit 160 through the third conductive line 185. The baseband frequency signal may be a signal used in an electronic device including the electronic device 100, but embodiments are not limited thereto. The second communication circuit 160 may convert a baseband frequency signal received from the communication module 170 into an IF signal. The second communication circuit 160 may transmit the converted IF signal to the first communication circuits 111, 121, 131 and 141 through the second conductive lines 181, 182, 183 and 184, respectively.

The first communication circuits 111, 121, 131 and 141 may convert the IF signal received from the second communication circuit 160 into an RF signal. The first communication circuits 111, 121, 131 and 141 may transmit the converted RF signal to the antennas 110, 120, 130 and 140 through the first conductive lines 112, 122, 132 and 142, respectively. A feeding element (e.g., a first feeding element 210 of FIG. 2B) of the antennas 110, 120, 130 and 140 may be electrically connected to the first communication circuits 111, 121, 131 and 141 through the first conductive lines 112, 122, 132 and 142, respectively.

Although the antennas 110, 120, 130 and 140 may radiate the RF signal received from the first communication circuits 111, 121, 131 and 141 in the air or through a medium, embodiments are not limited thereto.

Referring to FIG. 1, the electronic device 100 may include a printed circuit board (PCB) 150 (e.g., a main PCB) mounted in an internal space of the electronic device 100. According to some embodiments, the PCB 150 may include the communication module 170 and the second communication circuit 160.

According to some embodiments, each of the plurality of antennas 110, 120, 130 and 140 may be placed at a respective corner of the electronic device 100. However, embodiments are not limited to this placement. In some embodiments, various numbers of antennas may be placed at various positions in the internal space of the electronic device 100.

Hereinafter, the antenna 110 described above will be described with reference to FIGS. 2A to 3. Hereinafter, only the structure of the antenna 110 will be described. However, a same structure as the antenna 110 may be adopted for other antennas 120, 130, 140, and thus repeated description thereof is omitted for conciseness.

Figure 2A:
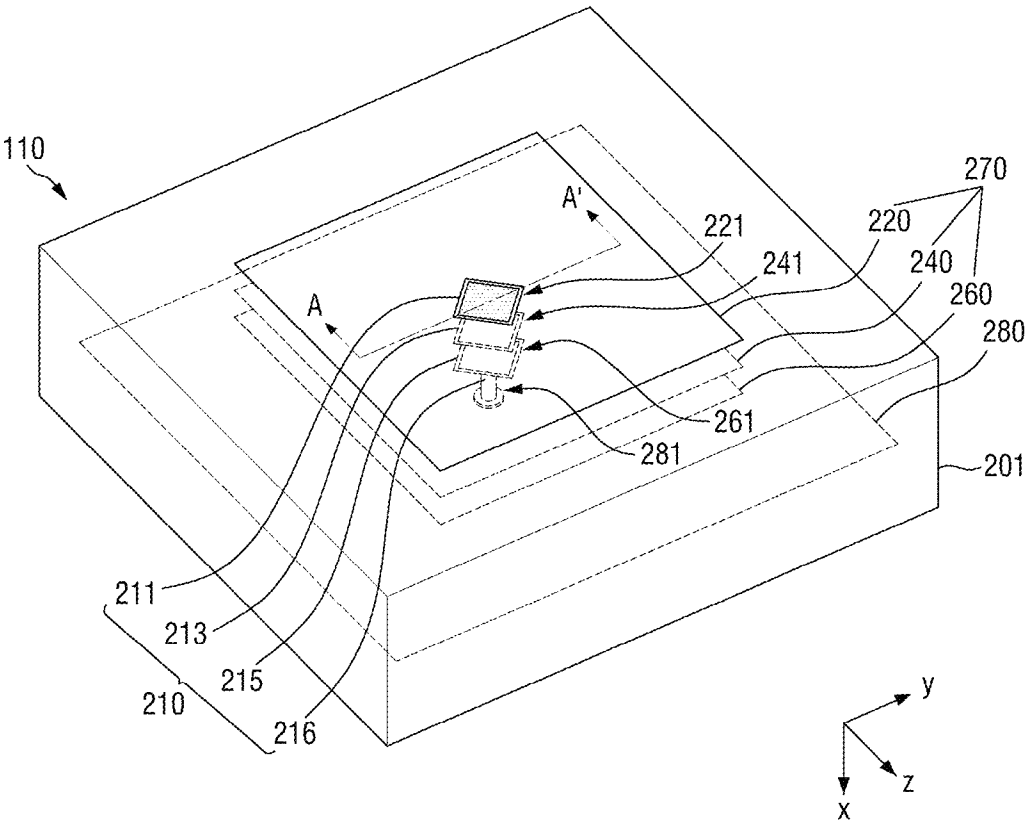
FIG. 2A is a perspective view of an antenna according to some embodiments.
Figure 2B:
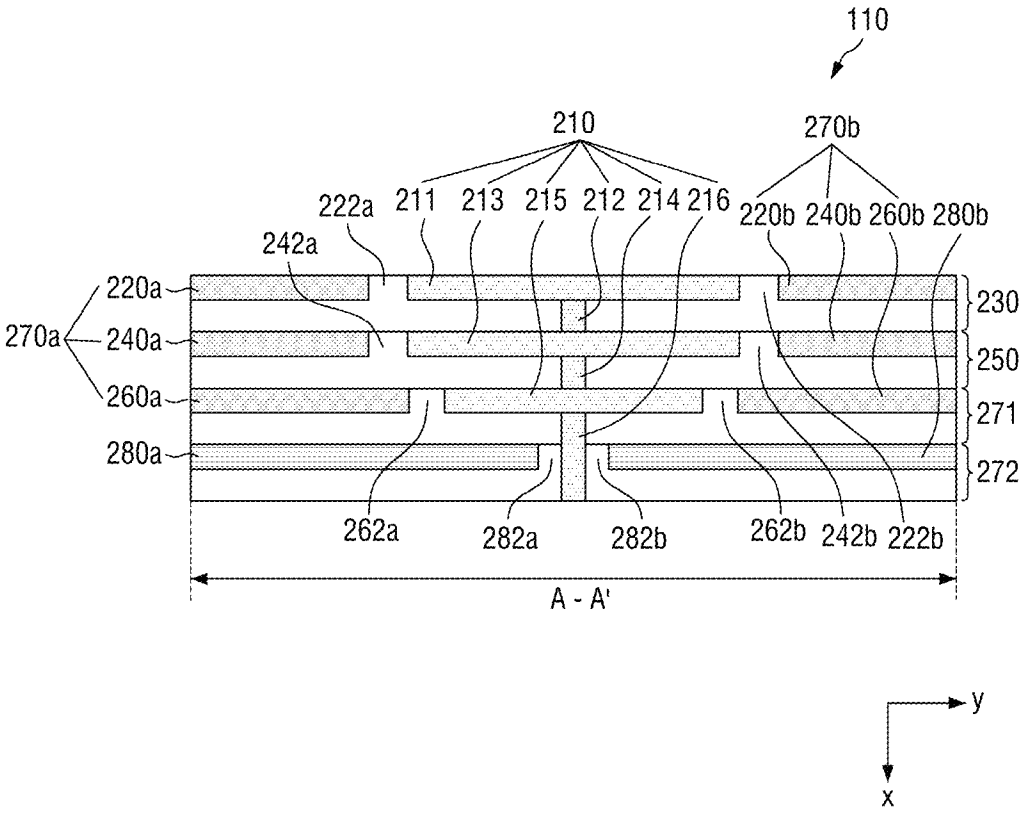
FIG. 2B is a cross-sectional view taken along a line A-A' of FIG. 2A.
Figure 2C:
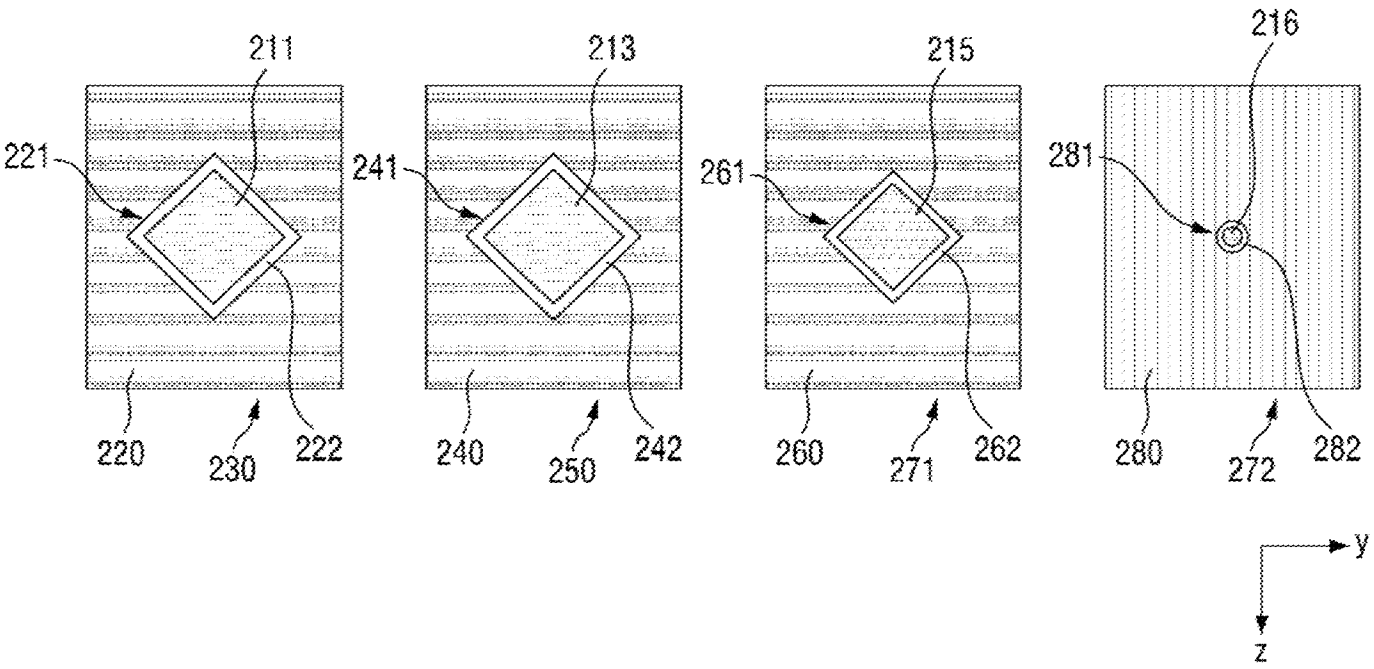
FIG. 2C is a plan view of each dielectric substrate of FIG. 2A.
Figure 3:
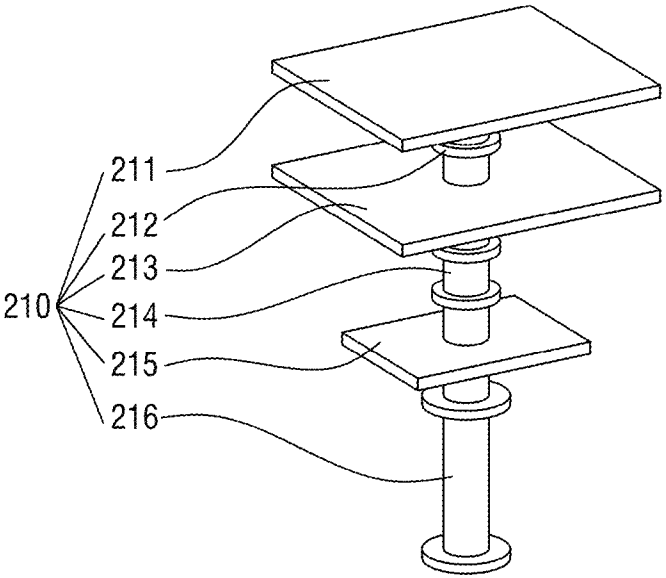
FIG. 3 is a perspective view of a first feeding element according to some embodiments.

FIG. 2A is a perspective view of an antenna according to some embodiments. FIG. 2B is a cross-sectional view taken along a line A-A' of FIG. 2A. FIG. 2C is a plan view of each dielectric substrate of FIG. 2A. FIG. 3 is a perspective view of a first feeding element according to some embodiments.

Referring to FIGS. 2A and 2B, the antenna 110 may include a dielectric substrate 201 and a first feeding element 210. In some embodiments, the dielectric substrate 201 may include a first dielectric substrate 230, a second dielectric substrate 250, a third dielectric substrate 271 and a fourth dielectric substrate 272. However, embodiments are not limited thereto.

The second dielectric substrate 250 may be stacked on a lower surface of the first dielectric substrate 230, the third dielectric substrate 271 may be stacked on a lower surface of the second dielectric substrate 250, and the fourth dielectric substrate 272 may be stacked on a lower surface of the third dielectric substrate 271. However, embodiments are not limited thereto and, in some embodiments, another dielectric substrate may be stacked between one or more of the first dielectric substrate 230, the second dielectric substrate 250, the third dielectric substrate 271, and the fourth dielectric substrate 272.

Referring to FIGS. 2B and 2C, the first dielectric substrate 230 may include a first radiation plate 220. The first radiation plate 220 may include a first radiation plate 220*a* and a first radiation plate 220*b*. The first radiation plate 220 may be placed on an upper surface of the first dielectric substrate 230. The first radiation plate 220 may include a first opening 221 therein. The first radiation plate 220 may include, for example, a metal material.

The second dielectric substrate 250 may include a second radiation plate 240. The second radiation plate 240 may include a second radiation plate 240*a* and a second radiation plate 240*b*. The second radiation plate 240 may be placed on an upper surface of the second dielectric substrate 250. The second radiation plate 240 may include a second opening 241 therein. The second radiation plate 240 may include, for example, a metal material.

The third dielectric substrate 271 may include a third radiation plate 260. The third radiation plate 260 may include a third radiation plate 260*a* and a third radiation plate 260*b*. The third radiation plate 260 may be placed on an upper surface of the third dielectric substrate 271. The third radiation plate 260 may include a third opening 261 therein. The third radiation plate 260 may include, for example, a metal material.

The fourth dielectric substrate 272 may include a ground plane 280. The ground plane 280 may include a ground plane 280*a* and a ground plane 280*b*. The ground plane 280 may be placed on an upper surface of the fourth dielectric substrate 272. The ground plane 280 may include a fourth opening 281 therein. In some embodiments, a shape of the fourth opening 281 may be circular.

The first feeding element 210 may include a first conductive plate 211, a second conductive plate 213, a third conductive plate 215, a first conductive member 212, a second conductive member 214 and a third conductive member 216. The first feeding element 210 may be, for example, a conductive material.

Referring to FIGS. 2A to 3, the first conductive plate 211 of the first feeding element 210 may be placed on a same plane as the first radiation plate 220. That is to say, the first conductive plate 211 may be placed on the same plane as the upper surface of the first radiation plate 220. The first conductive plate 211 may be placed in the first opening 221 and may be insulated from the first radiation plate 220 by the first insulating layer 222. The first insulating layer 222 may include a first insulating layer 222*a* and a first insulating layer 222*b*.

The first conductive member 212 may extend from a lower surface of the first conductive plate 211 to penetrate through the first dielectric substrate 230.

The second conductive plate 213 may be placed on a same plane as the second radiation plate 240. That is to say, the second conductive plate 213 may be placed on the same plane as the upper surface of the second radiation plate 240. The second conductive plate 213 may be placed in the second opening 241 and may be insulated from the second radiation plate 240 by the second insulating layer 242. The second insulating layer 242 may include a second insulating layer 242*a* and a first insulating layer 242*b*.

The second conductive member 214 may extend from the lower surface of the second conductive plate 213 to penetrate through the second dielectric substrate 250.

The third conductive plate 215 may be located on a same plane as the third radiation plate 260. That is to say, the third conductive plate 215 may be located on the same plane as the upper surface of the third radiation plate 260. The third conductive plate 215 may be located in the third opening 261 and may be insulated from the third radiation plate 260 by the third insulating layer 262. The third insulating layer 262 may include a third insulating layer 262*a* and a third insulating layer 262*b*.

The third conductive plate 215 may have an area smaller than that of the first conductive plate 211, and the third conductive plate 215 may have an area smaller than that of the second conductive plate 213. However, embodiments are not limited thereto. The coupling of the antenna 110 may be facilitated by adjusting the area.

The third conductive member 216 may extend from the lower surface of the third conductive plate 215 to penetrate through the third dielectric substrate 271. Further, the third conductive member 216 may be located in the fourth opening 281 of the ground plane 280, and may be insulated from the ground plane 280 by the fourth insulating layer 282. The fourth insulating layer 282 may include a fourth insulating layer 282*a* and a fourth insulating layer 282*b*.

The first feeding element 210 may be insulated from the radiator 270 and the ground plane 280 by the dielectric substrate 201. The RF signal may be provided to the first feeding element 210, and the first feeding element 210 may provide coupled feeding rather than direct feeding to the insulated radiator 270 and the ground plane 280. The antenna 110 may radiate a signal using the coupled feeding.

The antenna 110 may transmit and receive a signal of another frequency band by a part of the first feeding element 210, the radiator 270 and the ground plane 280. For example, the signals of another frequency band may be signals of an n258 band and an n260 band, and may be signals used in 5G communication. For example, the signal of the n258 band may be a signal of a band from 24.25 GHz to 27.5 GHz, and the signal of the n260 band may be a signal of a band from 37 GHz to 40 GHz. That is, the antenna 110 may transmit and receive a dual-band signal.

Referring to FIG. 2B, the first conductive plate 211 of the first feeding element 210, the second conductive plate 213 of the first feeding element 210, the first radiation plate 220, and the second radiation plate 240 may be coupled to transmit and receive, for example, signals of the n260 band. The third conductive plate 215 of the first feeding element 210, the third radiation plate 260, and the ground plane 280 may be coupled to transmit and receive, for example, signals of the n258 band.

Hereinafter, the antenna 110 will be described with reference to FIGS. 4A and 4B. Repeated part of contents of FIGS. 2A to 3 will not be explained, and differences will be mainly explained for conciseness.

Figure 4A:
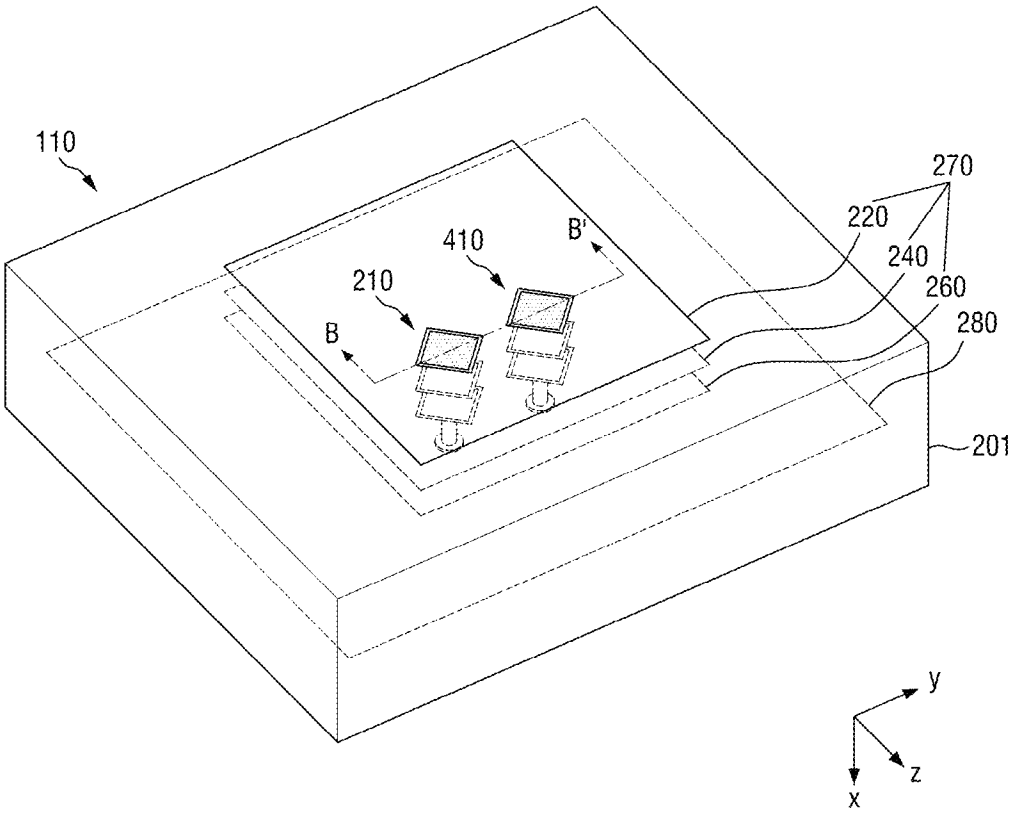
FIG. 4A is a perspective view of an antenna according to some embodiments.

FIG. 4A is a perspective view of an antenna according to some embodiments. FIG. 4B is a cross-sectional view taken along a line B-B' of FIG. 4A.

Referring to FIG. 4A, the antenna 110 may include a dielectric substrate 201, a first feeding element 210, and a second feeding element 410. The second feeding element 410 may be placed to be spaced apart from the first feeding element 210 in a y-direction. The antenna 110 may include a radiator 270 including a first radiation plate 220, a second radiation plate 240, and a third radiation plate 260. The first radiation plate 220 may include a fifth opening 421 therein. The antenna 110 may include a ground plane 280.

Figure 4B:
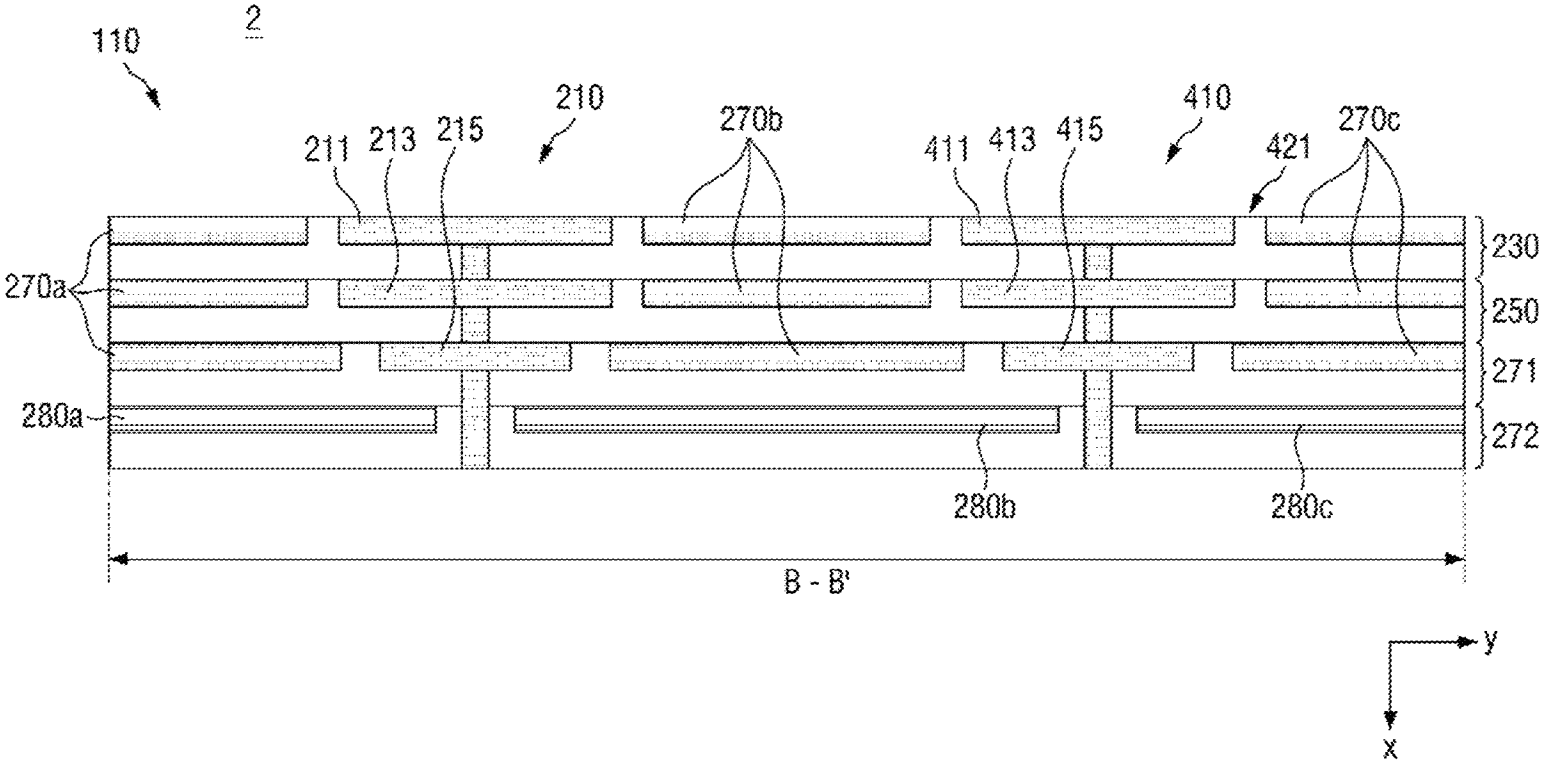
FIG. 4B is a cross-sectional view taken along a line B-B' of FIG. 4A.

Referring to FIG. 4B, the first dielectric substrate 230, the second dielectric substrate 250, the third dielectric substrate 271 and the fourth dielectric substrate 272 may extend in the y-direction. The second feeding element 410 may be placed in the extended part. The second feeding element 410 may have a same structure as the first feeding element 210, as illustrated in FIG. 4B. However, embodiments are not limited thereto and, in some embodiments, the second feeding element 410 may have a different structure from the structure of the first feeding elements 210.

Since the radiators 270*a*, 270*b*, and 270*c*, the ground planes 280*a*, 280*b*, and 280*c*, the first feeding element 210, and the second feeding element 410 are insulated by an insulating layer, the antenna 110 may be subjected to coupled feeding rather than direct feeding. That is, the RF signal may be provided to the first feeding element 210 and/or the second feeding element 410, and the signal may be fed to the radiators 270*a*, 270*b*, and 270*c* and the ground planes 280*a*, 280*b*, and 280*c* to radiate the RF signal. Finally, the antenna 110 may radiate the signal, using the coupled feeding.

Referring to FIGS. 4B and 2C, the first feeding element 210 and the second feeding element 410 may be placed to support dual polarization. In such a configuration, an antenna used in 5G communication may transmit and receive a vertical polarization and a horizontal polarization. For example, the vertical polarization may be transmitted and received through the first feeding element 210, and the horizontal polarization may be transmitted and received through the second feeding element 410. Antennas that support the dual polarization may be placed so that the vertical polarization and the horizontal polarization do not interfere with each other.

For example, a shape of the first conductive plate 211 of FIG. 2C when the first conductive plate 211 is viewed from an upper surface (i.e., in the x-direction) may be the same as a shape of the fourth conductive plate 411 of FIG. 4B when the fourth conductive plate 411 of the second feeding element 410 is viewed from the upper surface. Further, for example, a shape of the second conductive plate 213 of FIG. 2C when the second conductive plate 213 is viewed from the upper surface (i.e., in the x-direction) may be the same as a shape of the fifth conductive plate 413 when the fifth conductive plate 413 of the second feeding element 410 is viewed from the upper surface. Further, for example, a shape of the third conductive plate 215 of FIG. 2C when the third conductive plate 215 is viewed from the upper surface (i.e., in the x-direction) may be the same as a shape of the sixth conductive plate 415 when the sixth conductive plate 415 of the second feeding element 410 is viewed from the upper surface.

Figure 5A:
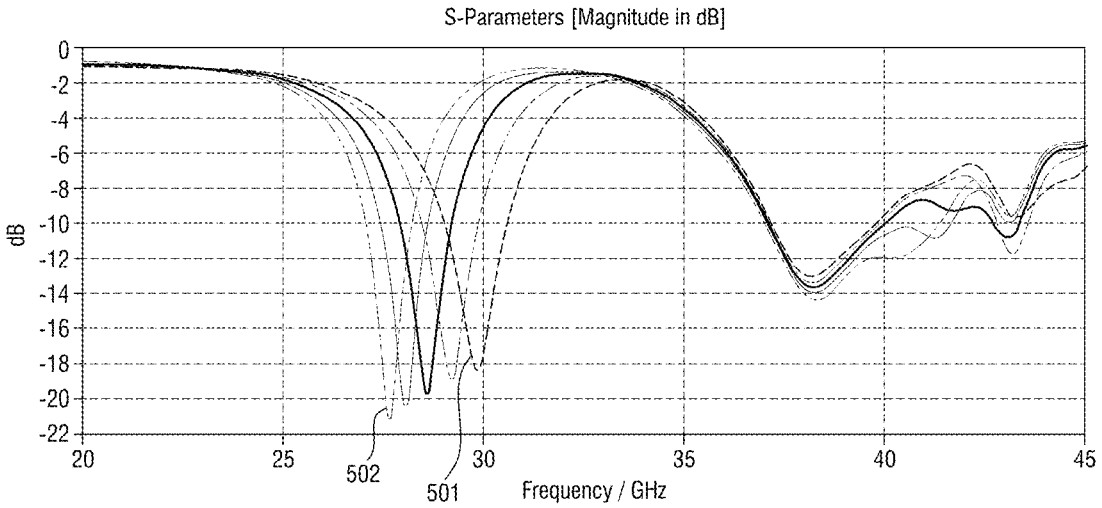
FIGS. 5A to 5C are s-parameter graphs of the antenna of FIGS. 2A-3 according to some embodiments.
Figure 5B:
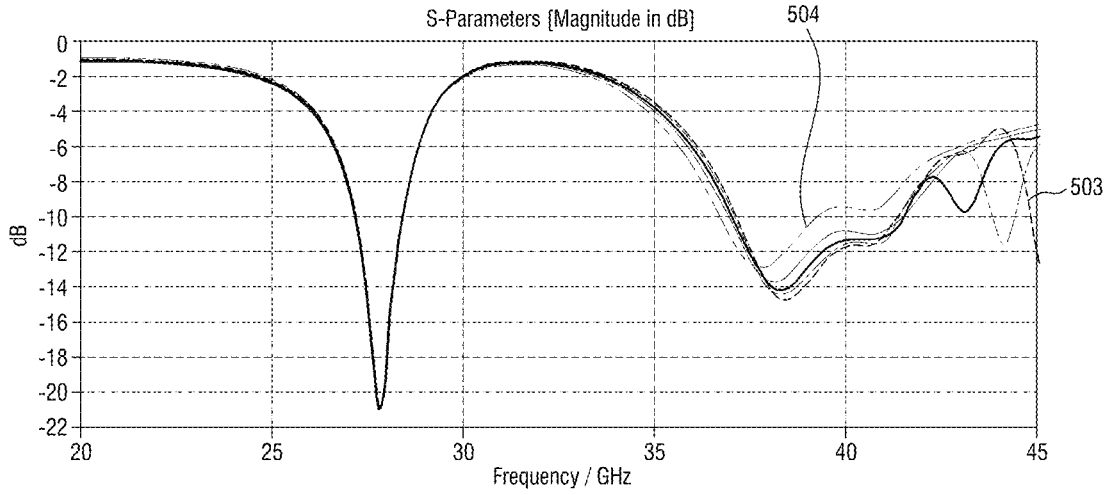
Figure 5C:
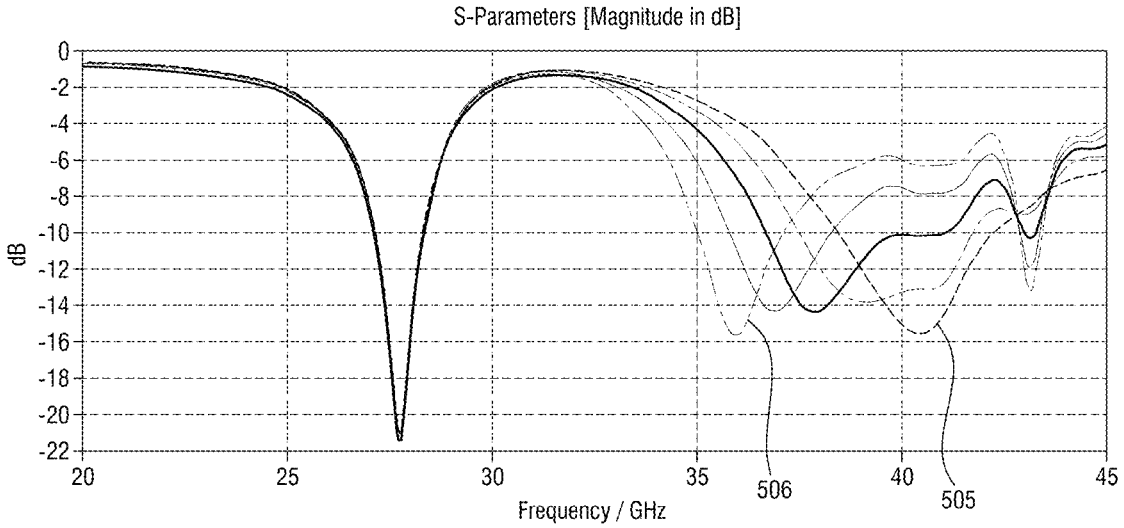

FIGS. 5A to 5C are s-parameter graphs of the antenna of FIGS. 2A-3 according to some embodiments.

Specifically, FIG. 5A is an s-parameter graph of the antenna 110 which changes by adjusting the area of the third radiation plate 260. As the area of the third radiation plate 260 increases, the graph may change from the s-parameter result of 501 to the s-parameter result of 502. That is, by adjusting the area of the third radiation plate 260, only the band of, for example, 24.25 GHz to 27.5 GHz which is a target frequency may be adjusted, without affecting the band of, for example, 37 GHz to 40 GHz.

FIG. 5B is an s-parameter graph of the antenna 110 which changes by adjusting the area of the second radiation plate 240. As the area of the second radiation plate 240 increases, the graph may change from the s-parameter result of 503 to the s-parameter result of 504. That is, by adjusting the area of the second radiation plate 240, only the band of, for example, 37 GHz to 40 GHz which is a target frequency may be adjusted, without affecting the band of, for example, 24.25 GHz to 27.5 GHz.

FIG. 5C is an s-parameter graph of the antenna 110 that changes by adjusting the area of the first radiation plate 220. As the area of the first radiation plate 220 increases, the graph may change from the s-parameter result of 505 to the s-parameter result of 506. That is, by adjusting the area of the first radiation plate 220, only the band of, for example, 37 GHz to 40 GHz which is a target frequency may be adjusted, without affecting the band of, for example, 24.25 GHz to 27.5 GHz.

Figure 5D:
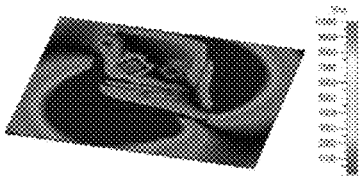
FIGS. 5D and 5E are field distribution diagrams according to a frequency band of the antenna of FIGS. 2A-3 according to some embodiments.
Figure 5E:
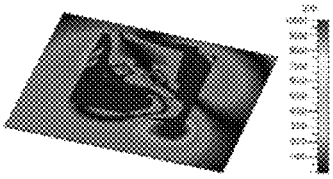

FIGS. 5D and 5E are field distribution diagrams according to the frequency band of the antenna of FIGS. 2A-3 according to some embodiments.

FIG. 5D shows a field distribution of the n258 band. When operating in the n258 band, the field may be radiated between the ground plane 280 and the third radiation plate 260. The frequency of the radiated signal may be, for example, from 24.25 GHz to 27.5 GHz.

FIG. 5E shows a field distribution of the n260 band. When operating in the n260 band, the first radiation plate 220 and the second radiation plate 240 operate, the third radiation plate 260 plays the role similar to the ground plane 280, and the signal may be radiated. The frequency of the radiated signal may be, for example, from 24.25 GHz to 27.5 GHz. FIG. 5E shows that the frequency may be adjusted independently as described with reference to FIGS. 5A to 5C.

Hereinafter, the antenna 110 described above will be described with reference to FIGS. 6A to 7. Repeated elements of FIGS. 2A to 3, 4A and 4B will not be explained for conciseness, and differences will be mainly explained.

Figure 6A:
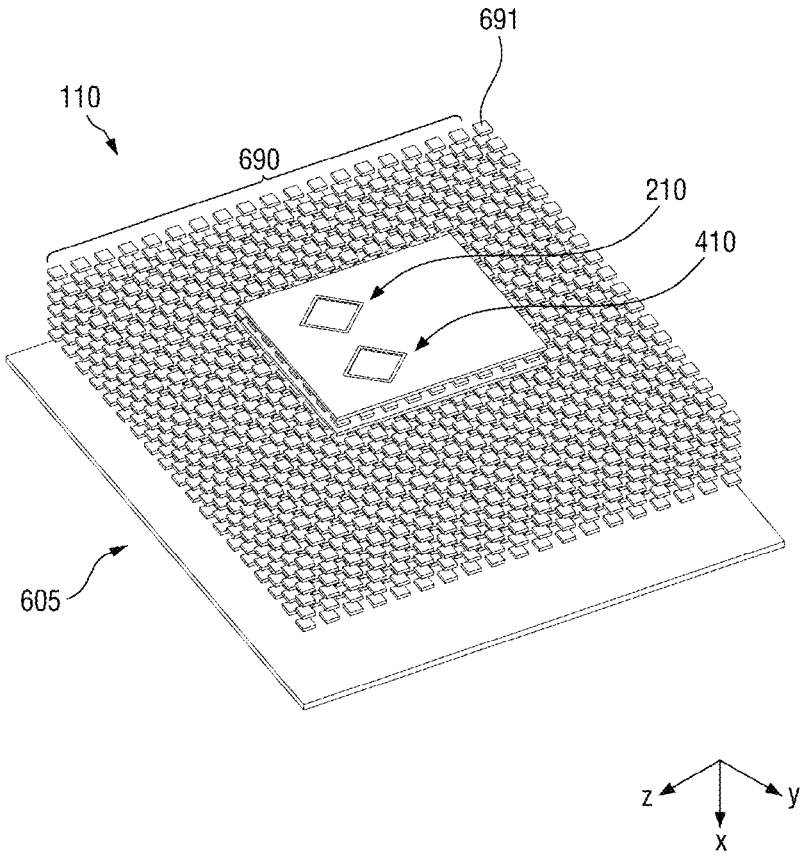
FIG. 6A is a perspective view of an antenna according to some embodiments.
Figure 6B:
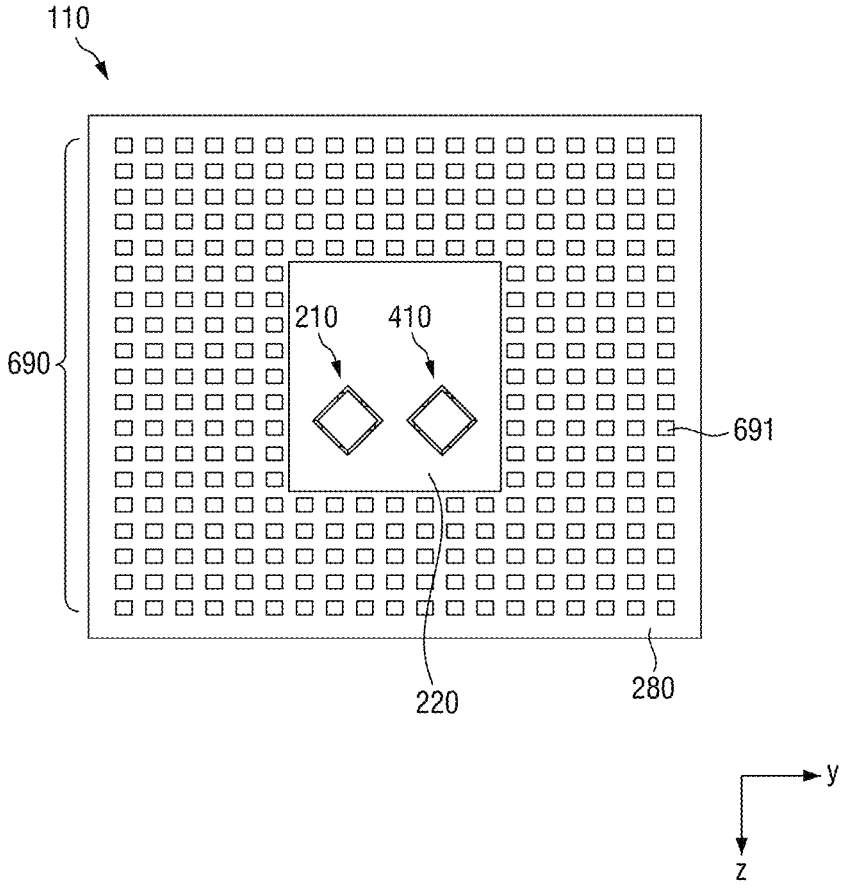
FIG. 6B is a top view of the antenna of FIG. 6A, according to some embodiments.
Figure 6C:
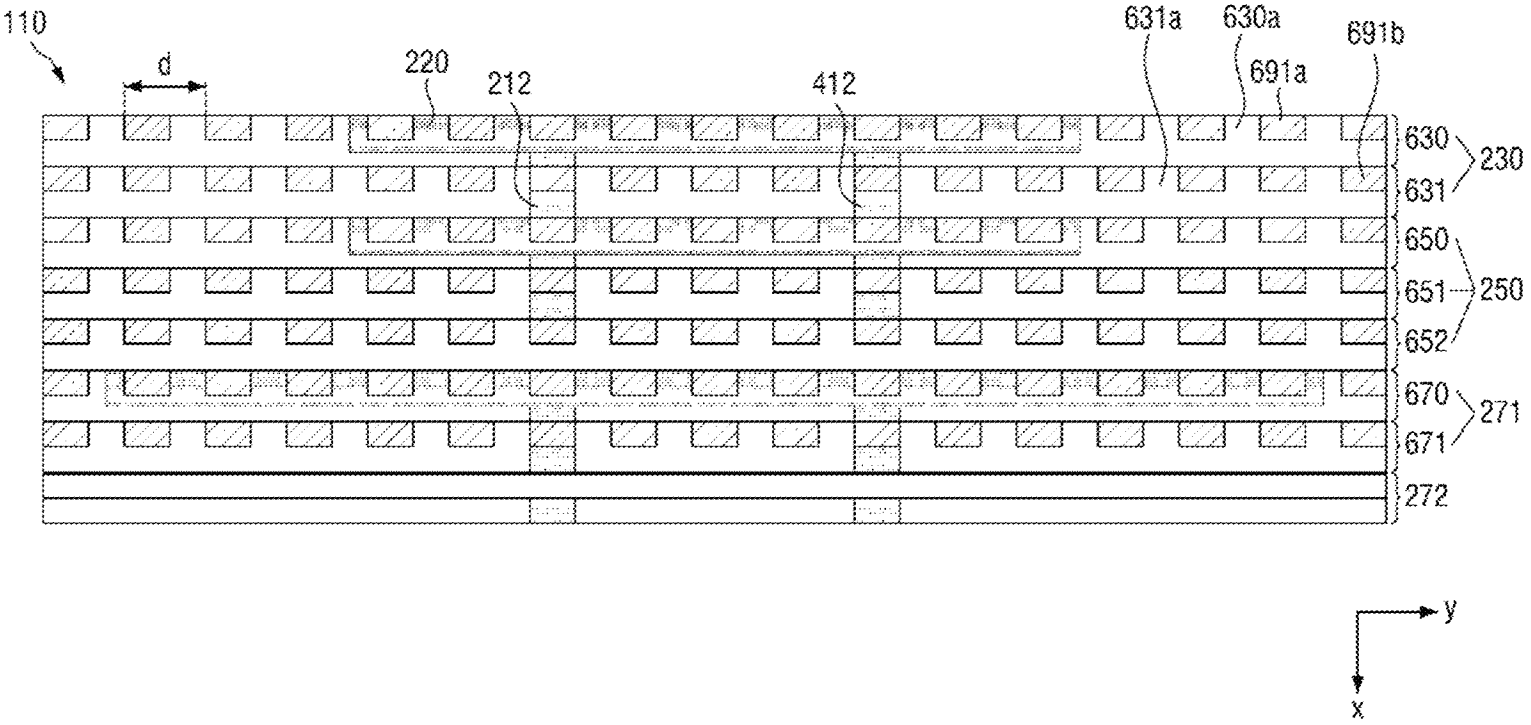
FIG. 6C is a side view of the antenna of FIG. 6A, according to some embodiments.
Figure 6D:
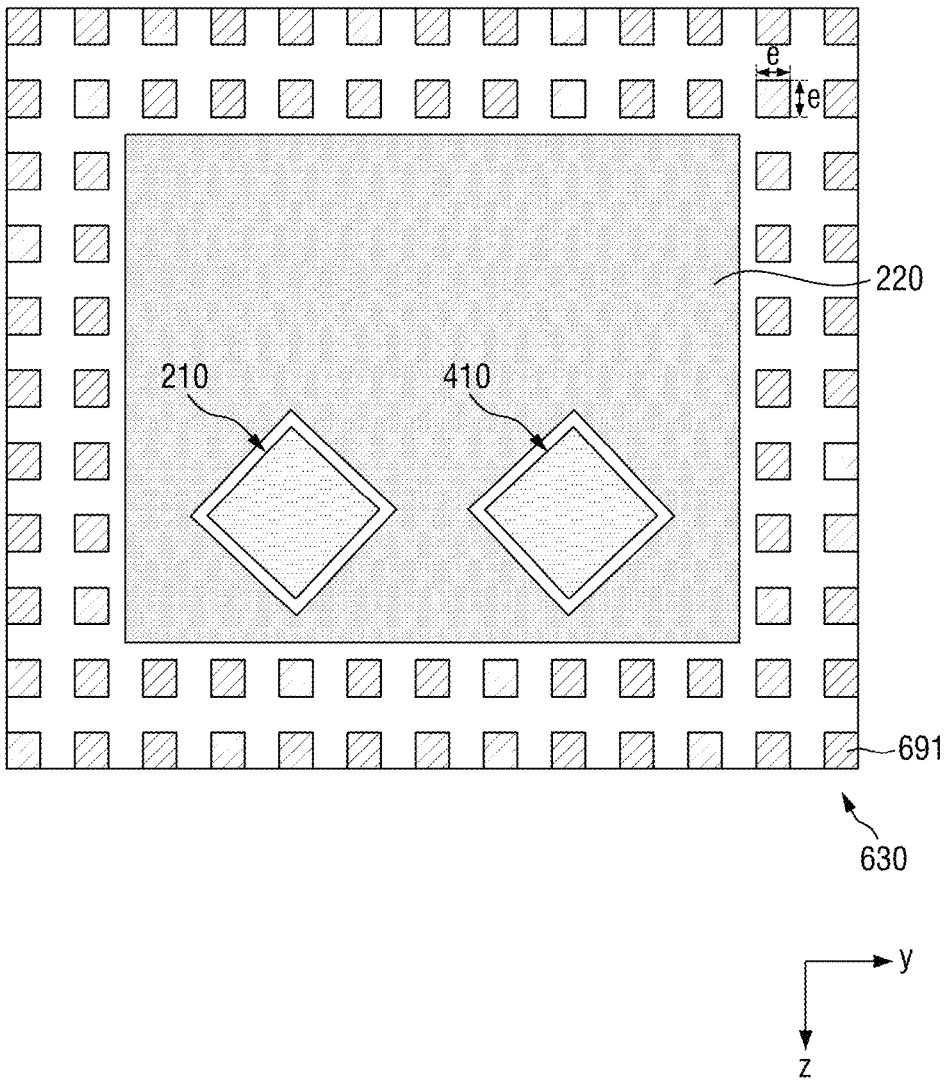
FIGS. 6D and 6E are top views of each dielectric substrate of the antenna of FIGS. 6A-6C, according to some embodiments.
Figure 6E:
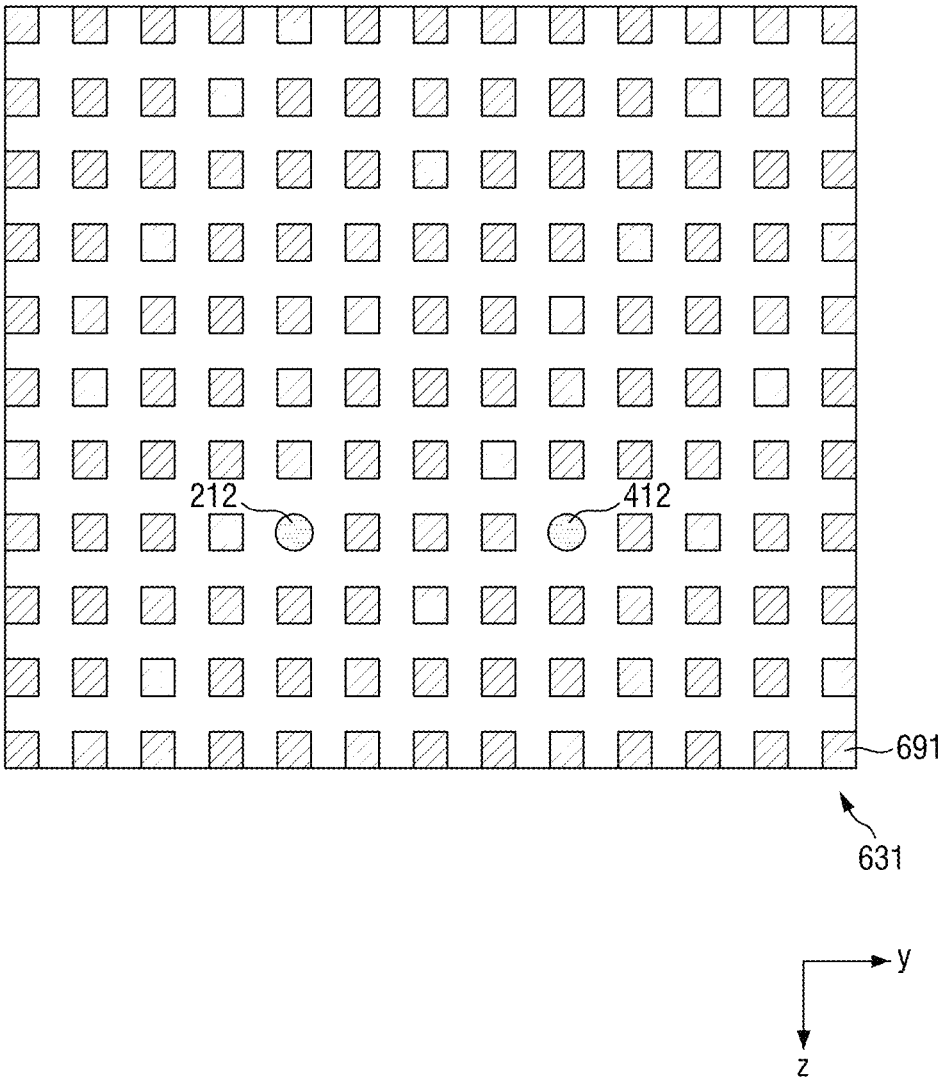
Figure 7:
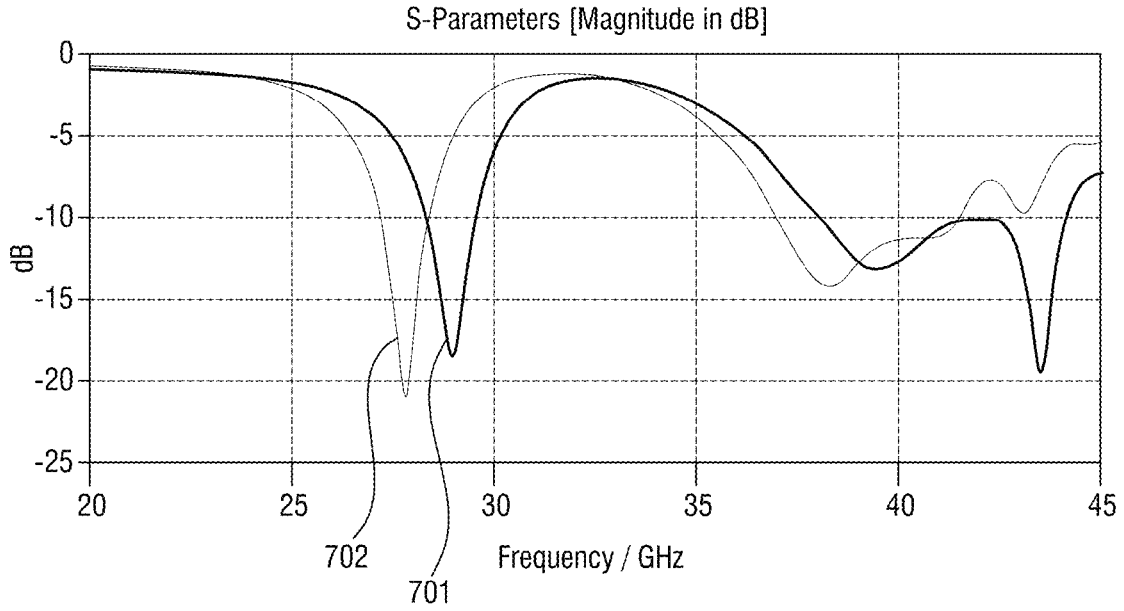
FIG. 7 is an s-parameter graph of the antenna according to some embodiments.

FIG. 6A is a perspective view of an antenna according to some embodiments. FIG. 6B is a top view of the antenna according to some embodiments. FIG. 6C is a side view of the antenna of FIG. 6A, according to some embodiments. FIGS. 6D and 6E are top views of each dielectric substrate of the antenna of FIG. 6A, according to some embodiments. FIG. 7 is an s-parameter graph of the antenna of FIG. 6A, according to some embodiments.

Referring to FIG. 6A, a dummy cell array 690 may include a plurality of dummy cells 691. The plurality of dummy cells 691 may be placed at regular intervals in the y-direction, and may be placed at regular intervals in the z-direction. However, embodiments are not limited thereto. In addition, in some embodiments, the dummy cells 691 may be placed at regular intervals in the x-direction. However, embodiments are not limited thereto. The dummy cells 691 may be, for example, metal materials.

FIG. 6B is a top view of the antenna 110 of FIG. 6A, according to some embodiments. When viewed from the top, the antenna may include a first feeding element 210 and a second feeding element 410, a first radiation plate 220, a third radiation plate 260, a ground plane 280 and a dummy cell array 690. However, embodiments are not limited thereto, and the antenna may include other components.

The dummy cell array 690 may include the plurality of dummy cells 691. In some embodiments, each of the plurality of dummy cells 691 may be the same. However, embodiments are not limited thereto. When viewed from the top, each of the dummy cells 691 may have a square shape having lengths in the y-direction and the z-direction. However, embodiments are not limited thereto. For example, when viewed from the top, the dummy cells 691 may be placed at regular intervals in the y-direction, and may be placed at regular intervals in the z-direction. However, embodiments are not limited thereto.

FIG. 6C is a side view of the antenna 110 according to some embodiments as viewed from a side of 605 of FIG. 6A.

Referring to FIG. 6C, the antenna 110 may include a fifth dielectric substrate 630, a sixth dielectric substrate 631, a seventh dielectric substrate 650, an eighth dielectric substrate 651, a ninth dielectric substrate 652, a tenth dielectric substrate 670, an eleventh dielectric substrate 671, and the fourth dielectric substrate 272. The first dielectric substrate 230 may include the fifth dielectric substrate 630 and the sixth dielectric substrate 631. The fifth dielectric substrate 630 may include a fifth insulating layer 630*a* and first dummy cells 691*a*, and the sixth dielectric substrate 631 may include a sixth insulating layer 631*a* and second dummy cells 691*b*. The second dielectric substrate 250 may include the seventh dielectric substrate 650, the eighth dielectric substrate 651, and the ninth dielectric substrate 652. The third dielectric substrate 271 may include the tenth dielectric substrate 670 and the eleventh dielectric substrate 671.

The antenna 110 may include the dummy cells 691. The dummy cells 691 may include the first dummy cells 691*a* and the second dummy cells 691*b*. When viewed from the side of 605, the dummy cells 691 may be placed at regular intervals in the y-direction and at regular intervals in the x-direction. However, embodiments are not limited thereto. For example, the plurality of dummy cells 691 included in the fifth dielectric substrate 630 may be periodically placed at a regular interval d in the y-direction.

FIG. 6D is an enlarged top view of the antenna 110 of FIGS. 6B and 6C, according to some embodiments. FIG. 6D illustrates the fifth dielectric substrate 630 of the antenna 110. However, it will be understood from the above description that the seventh dielectric substrate 650, the tenth dielectric substrate 670, and the fourth dielectric substrate 272 are similarly arranged with the fifth dielectric substrate 630 and thus a repeated description thereof is omitted for conciseness.

Referring to FIG. 6D, the fifth dielectric substrate 630 may include the first radiation plate 220, a portion of the first feeding element 210 and a portion of the second feeding element 410. The dummy cells 691 may be periodically placed, as viewed from the upper surface of the fifth dielectric substrate 630, except for the upper surface on which the first radiation plate 220 is placed. When viewed from the top, each of the dummy cells 691 may have a square shape having lengths e in the y-direction and the z-direction. However, embodiments are not limited thereto. The dummy cells 691 may be placed to be spaced at a regular interval in the y-direction and may be placed to be spaced at a regular interval in the z-direction. However, embodiments are not limited thereto. The dummy cells 691 may be placed to be insulated at a regular interval from the first radiation plate 220 by the insulating layer of the fifth dielectric substrate 630.

FIG. 6E is a top view of the sixth dielectric substrate 631 of the antenna 110 of FIG. 6C, according to some embodiments. FIG. 6E illustrates the sixth dielectric substrate 631 of the antenna 110. However, it will be understood from the above description that the eighth dielectric substrate 651, the ninth dielectric substrate 652, and the eleventh dielectric substrate 671 are similarly arranged with the sixth dielectric substrate 631 and thus a repeated description thereof is omitted for conciseness.

Referring to FIG. 6E, the sixth dielectric substrate 631 may include a first conductive member 212, a fourth conductive member 412, and dummy cells 691.

The dummy cells 691 are periodically placed when viewed from the upper surface of the sixth dielectric substrate 631, except for the upper surface on which the first conductive member 212 and the fourth conductive member 412 are placed. The dummy cells 691 may be placed to be spaced at a regular interval in the y-direction and may be placed to be spaced at a regular interval in the z-direction. However, embodiments are not limited thereto. The dummy cells 691 may be placed to be insulated at a regular interval from the first conductive member 212 and the fourth conductive member 412 by the insulating layer of the sixth dielectric substrate 631.

Referring also to FIG. 6D, the size of each of the dummy cells 691 may be a length e in the y-direction and a length e in the z-direction. However, embodiments are not limited thereto, and the size of the dummy cells 691 may vary. The length e may be, for example, 0.03λ at 28 GHz and 0.04λ at 39 GHz, that is, 0.3 mm. However, embodiments are not limited thereto and, in some embodiments, the length may vary.

By placing the dummy cell array 690, an Antenna in Package (AIP) PCB process rule may be satisfied. That is, by placing the dummy cells 691, for example, which are a metal material, in the antenna in which the metal material is included at a certain level or less, the metal material may be included at a certain level or more. Further, by periodically placing the dummy cells 691 with a reduced size (e.g., 0.3 mm), it is possible to minimize interference with the radiator (e.g., the first radiation plate 220) of the antenna 110.

FIG. 7 is an s-parameter graph of the antenna, according to some embodiments. Referring to FIG. 7, the s-parameter result of the antenna 110 having no dummy cells 690 is 701, and the s-parameter result of the antenna 110 having the dummy cell 690 is 702. The s-parameter result of the antenna having the dummy cells 690 may be shifted in a direction of a lower frequency. In this case, the s-parameter result may be shifted to optimize the frequency band, thereby allowing the area of the radiator (e.g., the first radiation plate 220) to be reduced. That is, the antenna 110 having the dummy cells 690 may be miniaturized.

Hereinafter, an antenna array 115 will be described with reference to FIGS. 8A and 8B. Repeated elements of FIGS. 2A to 3, 4A, 4B, and 6A to 6E will not be explained for conciseness, and differences will be mainly explained.

Figure 8A:
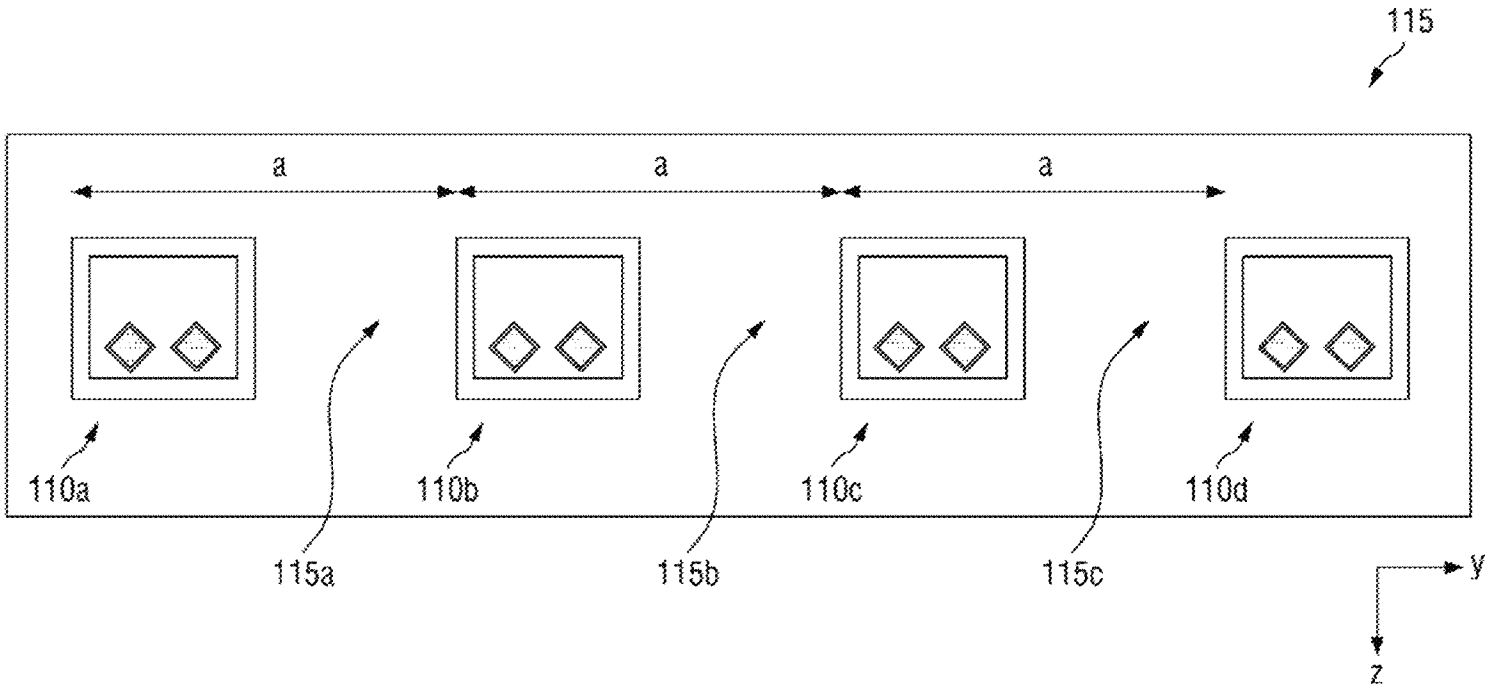
FIG. 8A is a top view of an antenna array according to some embodiments.

FIG. 8A is a top view of the antenna array according to some embodiments. FIG. 8B is a top view of the antenna array according to some embodiments.

Referring to FIG. 8A, the antenna array 115 may include a plurality of antennas 110*a*, 110*b*, 110*c*, and 110*d* arranged in the y-direction. FIG. 8A illustrates that four antennas which are the same are illustrated in the y-direction. However, embodiments are not limited thereto and, in some embodiments, of the number of antennas two or more rather than four, and in some embodiments, each of the antennas 110*a*, 110*b*, 110*c*, and 110*d* may not be the same. While the antennas 110*a*, 110*b*, 110*c*, and 110*d* are illustrated in FIG. 8A as the antenna 110 of FIG. 4A, embodiments are not limited thereto. For example, the antennas 110*a*, 110*b*, 110*c*, and/or 110*d* may be the antenna 110 of FIG. 2A, may be the antenna 110 of FIG. 4A, and/or may be the antenna 110 of FIG. 6A.

Each of the antennas 110*a*, 110*b*, 110*c*, and 110*d* may be placed to be spaced apart by a distance a in the y-direction. The distance a may be a first interval, and may be from about 3 mm to about 5 mm. The antenna 110*a* and the antenna 110*b* may be insulated by an insulating layer 115*a* between the antenna 110*a* and the antenna 110*b*. The antenna 110*b* and the antenna 110*c* may be insulated by an insulating layer 115*b* between the antenna 110*b* and the antenna 110*c*. Further, the antenna 110*c* and the antenna 110*d* may be insulated by an insulating layer 115*c* between the antenna 110*c* and the antenna 110*d*. In some embodiments, the antennas 110*a*, 110*b*, 110*c*, and 110*d* may be electrically connected to a communication circuit to transmit and receive signals. For example, the communication circuit may be the first communication circuits 111, 121, 131, 141 and/or the second communication circuit 160 illustrated in FIG. 1.

Figure 8B:
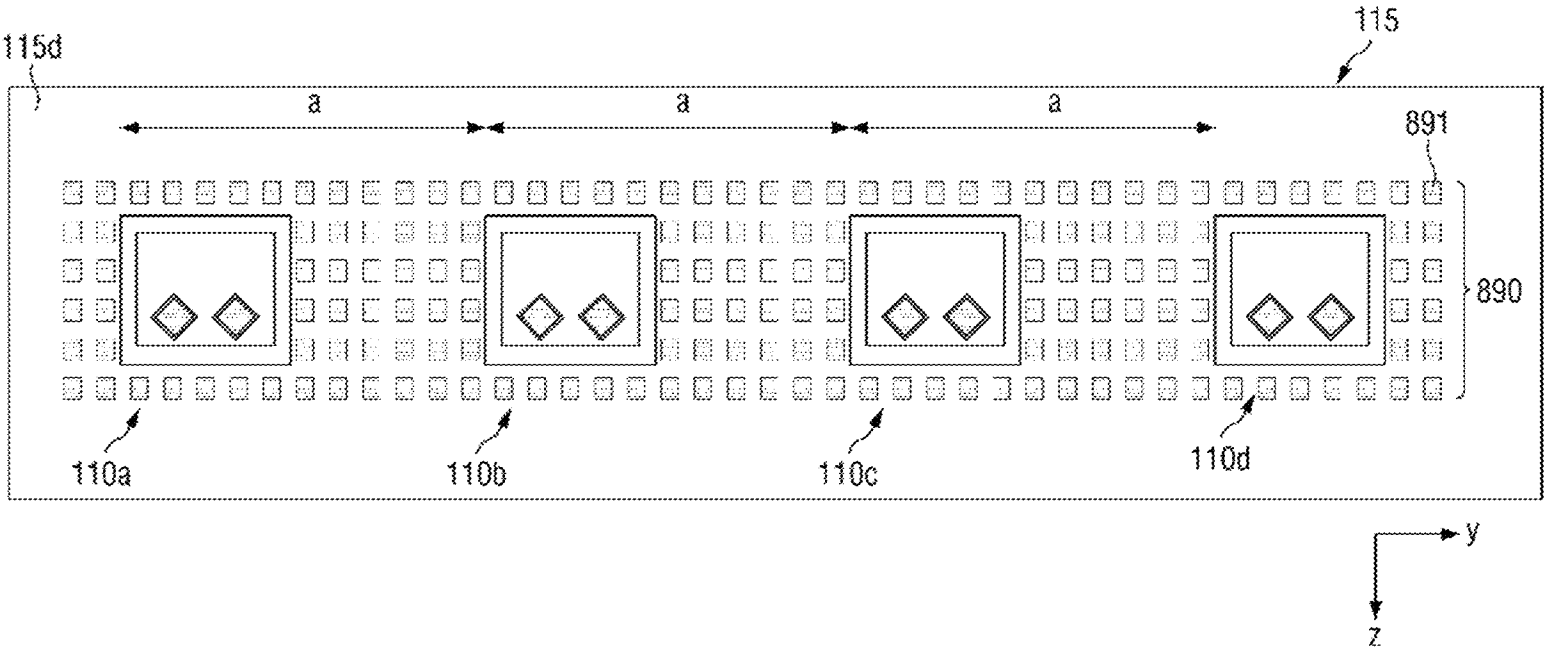
FIG. 8B is a top view of the antenna array of FIG. 8A, according to some embodiments.

FIG. 8B is a top view of an antenna array according to some embodiments. When viewed from the upper surface, a plurality of dummy cells 891 may be periodically placed at regular intervals in the y-direction and z-direction along the dielectric substrate. The regular interval may be a second interval. The second interval may be different than the first interval. The antenna array 115 may include an insulting layer 115*d*. The antenna array 115 may include a dummy cell array 890 that includes the dummy cells 891. It is noted that only a portion of the dummy cells 891 are schematically illustrated in FIG. 8B.

Hereinafter, the effects of the antenna array 115 will be described with reference to FIGS. 9C to 9F.

Figure 9A:
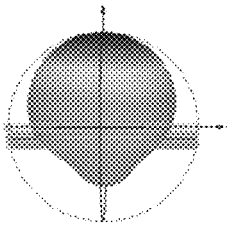
FIGS. 9A to 9B are radiation patterns according to a frequency band of an antenna according to some embodiments.
Figure 9B:
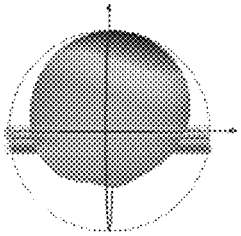

FIGS. 9A to 9B are radiation patterns according to a frequency band of an antenna according to some embodiments.

FIG. 9A shows the radiation pattern according to a 28 GHz frequency band of a single antenna (e.g., the antenna 110 of FIG. 2A). FIG. 9B shows the radiation pattern according to a 39 GHz frequency band of a single antenna (e.g., the antenna 110 of FIG. 2A). The single antenna (e.g., the antenna 110 of FIG. 2A) has a pattern that is radiated in all directions with no directionality.

FIGS. 9C to 9F are radiation patterns according to a frequency band of the antenna array 115 according to some embodiments. The radiation pattern of the antenna array 115 may have directionality as compared to the single antenna of FIGS. 9A and 9B.

Figure 9C:
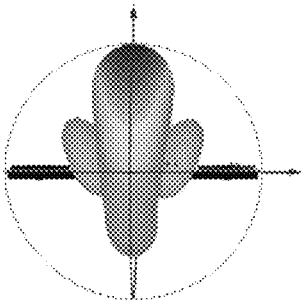
FIGS. 9C to 9F are radiation patterns according to the frequency band of the antenna array according to some embodiments.
Figure 9D:
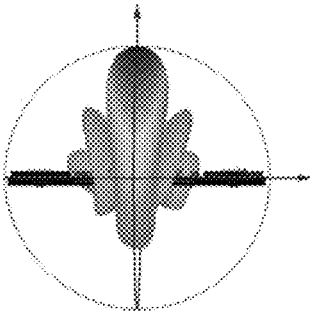
Figure 9E:
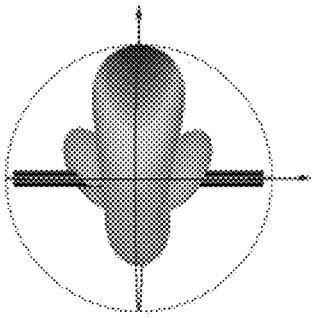
Figure 9F:
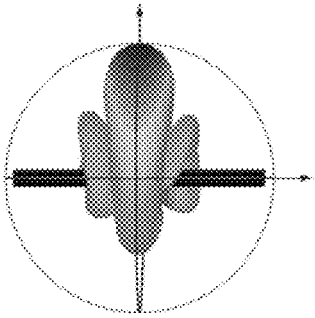

FIG. 9C illustrates a radiation pattern according to the 28 GHz frequency band of the antenna array 115 when the distance a is 4.5 mm. However, embodiments are not limited thereto, and the distance a may vary. FIG. 9D illustrates a radiation pattern according to the 39 GHz frequency band of the antenna array 115 when the distance a is 4.5 mm. However, embodiments are not limited thereto, and the distance a may vary. FIG. 9E illustrates a radiation pattern according to the 28 GHz frequency band of the antenna array 115 when the distance a is 4 mm. However, embodiments are not limited thereto, and the distance a may vary. FIG. 9F is a radiation pattern according to the 39 GHz frequency band of the antenna array 115 when the distance a is 4 mm. However, embodiments are not limited thereto, and the distance a may vary.

Referring FIGS. 9C to 9F, a side lobe when the distance a is 4 mm (e.g., FIGS. 9E and 9F) may be reduced as compared to a side lobe when the distance a is 4.5 mm (e.g., FIGS. 9C and 9D). That is, when the distance a is 4 mm, the radiation pattern may be optimized. However, embodiments are not limited thereto, and another distance may be provided.

As described above, various embodiments have been described with reference to the accompanying drawings. However, embodiments are not limited to the above embodiments, and the various embodiments may be manufactured in various different forms. Those of ordinary skill in the art will understand that an antenna according to the present disclosure may be embodied in other specific forms without departing from the spirit or essential characteristics of the inventive concept. Therefore, it should be understood that the embodiments described above are illustrative in all aspects and not restrictive.

What is claimed is:

1. An antenna comprising:

a first dielectric substrate which includes a first insulating layer, and a first radiation plate including a first opening configured to expose an upper surface of the first insulating layer; and a first feeding element which is disposed in the first opening to penetrate the first insulating layer in a direction extending toward a lower surface of the first dielectric substrate, is the first feeding element being insulated from the first radiation plate by the first insulating layer, wherein the first feeding element includes a first conductive plate having an upper surface located on a same plane as an upper surface of the first radiation plate.

2. The antenna of claim 1, further comprising:

a second dielectric substrate which includes a second insulating layer, and a second radiation plate including a second opening configured to expose an upper surface of the second insulating layer, wherein the second dielectric substrate is stacked on the lower surface of the first dielectric substrate, the first feeding element is disposed in the second opening to penetrate the second insulating layer in a direction toward a lower surface of the second dielectric substrate, is the first feeding element being insulated from the second radiation plate by the second insulating layer, and the first feeding element further includes a second conductive plate having an upper surface located on a same plane as an upper surface of the second radiation plate.

3. The antenna of claim 2, further comprising:

a third dielectric substrate which includes a third insulating layer, and a third radiation plate including a third opening configured to expose an upper surface of the third insulating layer; and a fourth dielectric substrate which includes a fourth insulating layer, and a ground plane including a fourth opening configured to expose an upper surface of the fourth insulating layer, wherein the third dielectric substrate is stacked on the lower surface of the second dielectric substrate, the fourth dielectric substrate is stacked on a lower surface of the third dielectric substrate, the first feeding element is disposed in the third opening to penetrate the third insulating layer in a direction toward the lower surface of the third dielectric substrate, is the first feeding element being insulated from the third radiation plate by the third insulating layer, the first feeding element further includes a third conductive plate having an upper surface placed on a same plane as an upper surface of the third radiation plate, and the first feeding element is disposed in the fourth opening to penetrate the fourth insulating layer in a direction toward a lower surface of the fourth dielectric substrate, is the first feeding element being insulated from the ground plane by the fourth insulating layer.

4. The antenna of claim 3, wherein a signal of a first frequency is transmitted and received using the first radiation plate, the second radiation plate, the first conductive plate, and the second conductive plate, and a signal of a second frequency different from the first frequency is transmitted and received using the third radiation plate, the ground plane, and the third conductive plate.

5. The antenna of claim 3, wherein an area of the third conductive plate is less than or equal to an area of at least one of the first conductive plate or the second conductive plate.

6. The antenna of claim 1, further comprising:

a second feeding element, wherein the first radiation plate includes a fifth opening spaced apart from the first opening to expose the upper surface of the first insulating layer, the second feeding element is disposed in the fifth opening to penetrate the first insulating layer in the direction of the lower surface of the first dielectric substrate, is the second feeding element being insulated from the first radiation plate by the first insulating layer, and the second feeding element includes a fourth conductive plate having an upper surface located on a same plane as the upper surface of the first radiation plate.

7. The antenna of claim 6, wherein a shape of the first conductive plate as viewed from the upper surface of the first conductive plate is a same shape as a shape of the fourth conductive plate as viewed from the upper surface of the fourth conductive plate.

8. The antenna of claim 1, wherein the first dielectric substrate includes a fifth dielectric substrate which includes a fifth insulating layer, and a plurality of first dummy cells configured to expose an upper surface of the fifth insulating layer, the plurality of first dummy cells being periodically disposed along the upper surface of the fifth insulating layer and being insulated from the first radiation plate by the fifth insulating layer.

9. The antenna of claim 8, wherein the first dielectric substrate includes a sixth dielectric substrate which includes a sixth insulating layer, and a plurality of second dummy cells which expose an upper surface of the sixth insulating layer, the plurality of second dummy cells being periodically disposed along the upper surface of the sixth insulating layer, and the sixth dielectric substrate is stacked on a lower surface of the fifth dielectric substrate.

10. The antenna of claim 8, wherein when viewed from the upper surface of the first dielectric substrate, a length of each of the plurality of first dummy cells in a second direction perpendicular to a first direction which is the direction that extends toward the lower surface of the first dielectric substrate is 0.2 mm to 0.4 mm, and a length of each of the plurality of first dummy cells in a third direction perpendicular to the first direction and the second direction is 0.2 mm to 0.4 mm.

11. An antenna array comprising:

a first antenna which includes a first radiation plate including a first opening, and a first conductive plate disposed in the first opening; and a second antenna which is disposed to be spaced apart from the first antenna at a first interval in a first direction, and includes a second radiation plate including a second opening, and a second conductive plate disposed in the second opening, wherein the first antenna is insulated from the second antenna by a first insulating layer, the first opening exposes an upper surface of the first conductive plate, and an upper surface of a second insulating layer which insulates the first conductive plate and the first radiation plate, and the second opening exposes an upper surface of the second conductive plate, and an upper surface of a third insulating layer which insulates the second conductive plate and the second radiation plate.

12. The antenna array of claim 11, further comprising:

a third antenna which is disposed to be spaced apart from the second antenna at the first interval in the first direction, and includes a third radiation plate including a third opening, and a third conductive plate disposed in the third opening; and a fourth antenna which is disposed to be spaced apart from the third antenna at the first interval in the first direction, and includes a fourth radiation plate including a fourth opening, and a fourth conductive plate disposed in the fourth opening, wherein the second antenna is insulated from the third antenna by a fourth insulating layer, and the third antenna is insulated from the fourth antenna by a fifth insulating layer, the third opening exposes an upper surface of the third conductive plate, and an upper surface of a sixth insulating layer which insulates the third conductive plate and the third radiation plate, and the fourth opening exposes an upper surface of the fourth conductive plate, and an upper surface of a seventh insulating layer which insulates the fourth conductive plate and the fourth radiation plate.

13. The antenna array of claim 12, wherein the first radiation plate includes a fifth opening disposed to be spaced apart from the first opening, the first antenna includes a fifth conductive plate disposed in the fifth opening, the second radiation plate includes a sixth opening disposed to be spaced apart from the second opening, the second antenna includes a sixth conductive plate disposed in the sixth opening, the third radiation plate includes a seventh opening disposed to be spaced apart from the third opening, the third antenna includes a seventh conductive plate disposed in the seventh opening, the fourth radiation plate includes an eighth opening disposed to be spaced apart from the fourth opening, the fourth antenna includes an eighth conductive plate disposed in the eighth opening, the fifth opening exposes an upper surface of the fifth conductive plate, and an upper surface of an eighth insulating layer which insulates the fifth conductive plate and the first radiation plate, the sixth opening exposes an upper surface of the sixth conductive plate, and an upper surface of a ninth insulating layer which insulates the sixth conductive plate and the second radiation plate, the seventh opening exposes an upper surface of the seventh conductive plate, and an upper surface of a tenth insulating layer which insulates the seventh conductive plate and the third radiation plate, and the eighth opening exposes an upper surface of the eighth conductive plate, and an upper surface of an eleventh insulating layer which insulates the eighth conductive plate from the fourth radiation plate.

14. The antenna array of claim 13, wherein the first to fourth antennas are electrically connected to a communication circuit to transmit and receive signals.

15. The antenna array of claim 13, wherein a shape of the first conductive plate when viewed from the upper surface of the first conductive plate is a same shape as a shape of the fifth conductive plate when viewed from the upper surface of the fifth conductive plate, a shape of the second conductive plate when viewed from the upper surface of the second conductive plate is a same shape as a shape of the sixth conductive plate when viewed from the upper surface of the sixth conductive plate, a shape of the third conductive plate when viewed from the upper surface of the third conductive plate is a same shape as a shape of the seventh conductive plate when viewed from the upper surface of the seventh conductive plate, and a shape of the fourth conductive plate when viewed from the upper surface of the fourth conductive plate is a same shape as a shape of the eighth conductive plate when viewed from the upper surface of the eighth conductive plate, thereby supporting dual polarization to prevent an occurrence of interference between polarization and horizontal polarization.

16. The antenna array of claim 11, wherein the first interval is 3 mm to 5 mm.

17. The antenna array of claim 11, further comprising:

a plurality of dummy cells exposed on the upper surface of the first insulating layer and periodically disposed along the upper surface of the first insulating layer, the plurality of dummy cells being disposed at a second interval different than the first interval.

18. A communication device comprising:

a first radiation plate including a first opening;

a second radiation plate including a second opening, is the second radiation plate being disposed under the first radiation plate to be spaced apart from a lower surface of the first radiation plate;

a third radiation plate including a third opening, is the third radiation plate being disposed under the second radiation plate to be spaced apart from a lower surface of the second radiation plate;

a ground plane including a fourth opening, is the ground plane being disposed under the third radiation plate to be spaced apart from a lower surface of the third radiation plate;

a first feeding element; and a first communication circuit which is electrically connected to the first feeding element and transmits and receives signals, wherein the first feeding element is spaced apart from the first radiation plate in the first opening, and extends in a direction away from the lower surface of the first radiation plate through the first opening, the first feeding element is spaced apart from the second radiation plate in the second opening, and extends in a direction away from the lower surface of the second radiation plate through the second opening, the first feeding element is spaced apart from the third radiation plate in the third opening, and extends in a direction away from the lower surface of the third radiation plate through the third opening, the first feeding element is spaced apart from the ground plane in the fourth opening, and extends in a direction away from the lower surface of the ground plane through the fourth opening, and the first feeding element includes a first conductive plate located on a same plane as an upper surface of the first radiation plate, a second conductive plate located on a same plane as an upper surface of the second radiation plate, and a third conductive plate located on a same plane as an upper surface of the third radiation plate.

19. The communication device of claim 18, further comprising:

a second feeding element, wherein the first radiation plate includes a fifth opening disposed to be spaced apart from the first opening, the second radiation plate includes a sixth opening disposed to be spaced apart from the second opening, the third radiation plate includes a seventh opening disposed to be spaced apart from the third opening, the ground plane includes an eighth opening disposed to be spaced apart from the fourth opening, the second feeding element is spaced apart from the first radiation plate in the fifth opening, and extends in the direction away from the lower surface of the first radiation plate through the fifth opening, the second feeding element is spaced apart from the second radiation plate in the sixth opening, and extends in the direction away from the lower surface of the second radiation plate through the sixth opening, the second feeding element is spaced apart from the third radiation plate in the seventh opening, and extends in the direction away from the lower surface of the third radiation plate through the seventh opening, the second feeding element is spaced apart from the ground plane in the eighth opening, and extends in the direction away from the lower surface of the ground plane through the eighth opening, the communication device further includes a fourth conductive plate placed on a same plane as the upper surface of the first radiation plate, a fifth conductive plate placed on a same plane as the upper surface of the second radiation plate, and a sixth conductive plate placed at a same plane as the upper surface of the third radiation plate, and the first communication circuit is electrically connected to the second feeding element to transmit and receive signals.

20. The communication device of claim 19, wherein the first to fourth openings have a same center point, and the fifth to eighth openings have a same center point.

* * * * *